United States Patent [19]

MacGregor

[11] Patent Number: 4,768,655

[45] Date of Patent: Sep. 6, 1988

[54] MESSAGE ORGANIZER

[75] Inventor: Francis W. MacGregor, Simsbury, Conn.

[73] Assignee: Quad Research Inc., Avon, Conn.

[21] Appl. No.: 71,636

[22] Filed: Jul. 9, 1987

[51] Int. Cl.[4] ..... B42F 17/00

[52] U.S. Cl. ..... 211/11; 211/126

[58] Field of Search ..... 211/11, 133, 126, 188, 211/10, 194; 206/555, 557

[56] References Cited

U.S. PATENT DOCUMENTS

| | | | |
|---|---|---|---|
| 2,100,720 | 11/1937 | Page | 206/557 X |
| 2,235,709 | 3/1941 | Hearn et al. | 211/126 X |
| 3,219,232 | 11/1965 | Wilson | 211/126 X |
| 4,000,817 | 1/1977 | Sanders et al. | 211/126 X |
| 4,074,810 | 2/1978 | Juergens et al. | 211/126 X |

*Primary Examiner*—J. Franklin Foss
*Assistant Examiner*—Sarah A. Lechok Eley
*Attorney, Agent, or Firm*—McCormick, Paulding and Huber

[57] ABSTRACT

A message organizer formed by a plurality of substantially identical message trays arranged in vertically stacked relation and connected in snap-engagement to each other and to a support base. Diagonally opposite corners of each message tray are truncated to expose the corners of rectangular message sheets received within the trays. The trays are closed at opposite sides and open at the front and rear ends. Inclined inner and outer surfaces on the low opposite end walls of each message tray provide angled lable areas and aid in the placement of messages in and removal of messages from the trays.

20 Claims, 3 Drawing Sheets

MESSAGE ORGANIZER

BACKGROUND OF THE INVENTION

This invention relates in general to paper storage racks and trays and deals more particularly with an improved desk-top message storage rack.

A receptionst in a busy business office may be required, in addition to other duties, to receive, record, colate and store incoming telephone messages for a number of different individuals who are not immediately available to receive their messages.

It is the general aim of the present invention to provide an improved desk top message storage rack or message organizer to facilitate efficient handling and distribution of telephone messages.

SUMMARY OF THE INVENTION

In accordance with the invention a message organizer comprises a plurality of substantially identical message receiving trays. Each tray has a planar bottom wall, a pair of parallel side walls, and a pair of parallel end walls normal to said side walls. The upper edges of said end walls are disposed a substantial distance below the upper edges of said side walls. Each tray has at least one truncated corner defined by a free edge of one of the end walls, a free end of an associated one of the side walls and an associated edge of the planar bottom wall which extends between the latter free ends. The end wall which defines the truncated corner has an inner surface which extends along its length and is upwardly and outwardly inclined to its upper edge. A means is provided for maintaining the trays in vertically stacked relation with the truncated corners thereof in generally vertically alignment.

DETAILED DESCRIPTION OF PREFERRED EMBODIMENT

Figure 1:
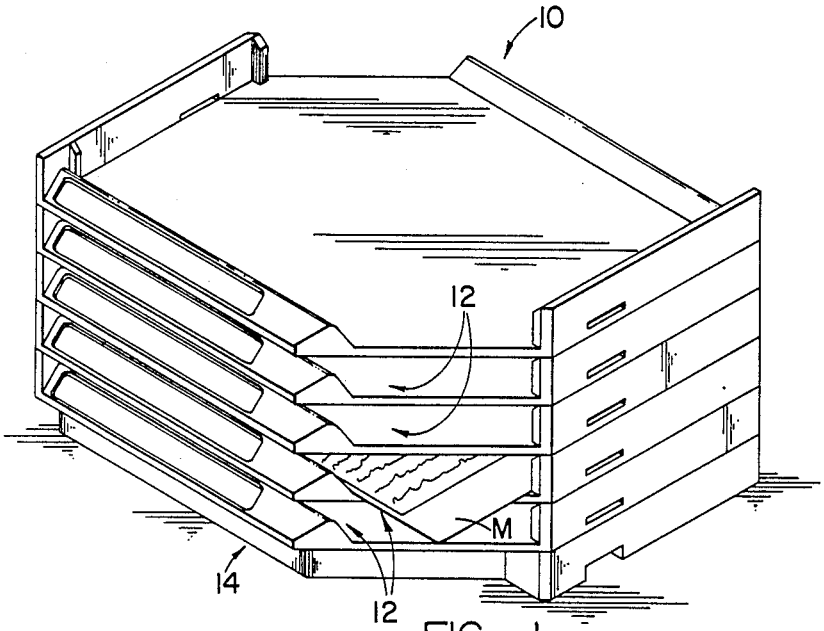
FIG. 1 is a perspective view of a message orgainizer embodying the present invention.

Referring to the drawings, a message organizer embodying the present invention is indicated generally by the reference numeral 10 in FIG. 1. The illustrated message organizer 10 essentially comprises a plurality of substantially identical message trays, designated generally by the numerals 12,12, arranged in vertically stacked relation and connected to each other and to a common support base indicated generally at 14. Each message tray 12 is adapted to hold a plurality of message slips or forms upon which telephone messages or the like are recorded for delivery to a specific individuals whose names may appear on one or more labels affixed to each of the message trays. The message organizer 10 is particularly adapted for positioning on a desk and is constructed and arranged so that a message form, such as the form M shown in FIG. 1, may be quickly and easily inserted into or removed from an associated message tray 12. Message forms contained within the various trays are immediately visible to a person seated at the desk or another person approaching the desk, all of which will be hereinafter more fully described.

Figure 4:
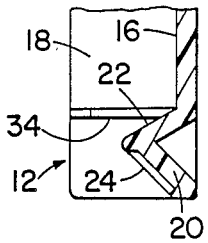
FIG. 4 is a still further enlarged fragmentary sectional view taken along the line 4—4 of FIG. 3.
Figure 2:
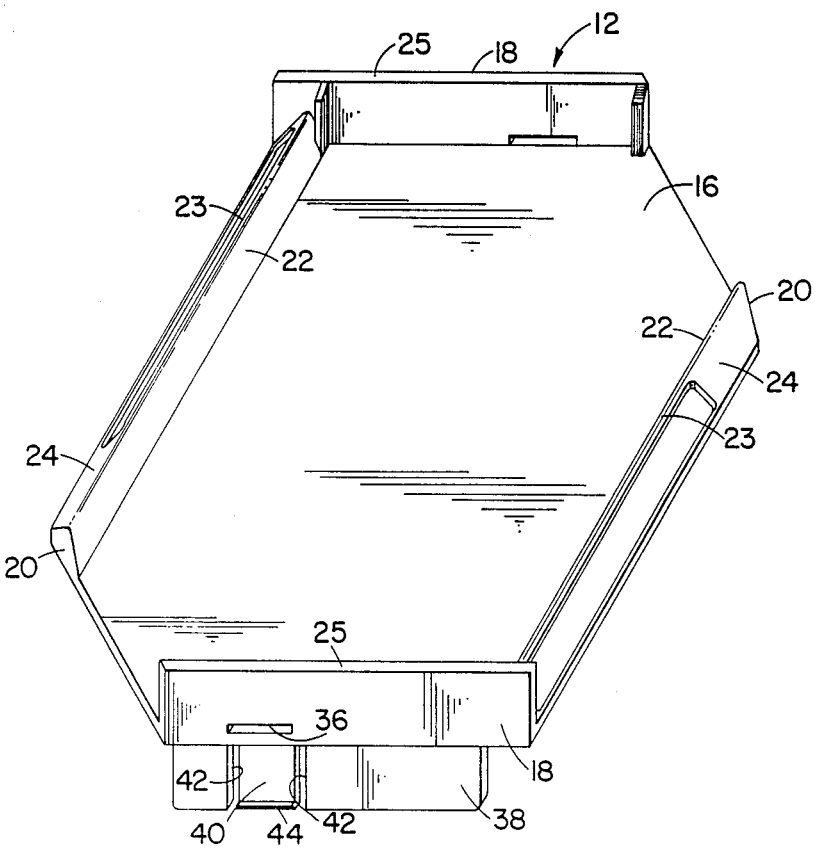
FIG. 2 is a somewhat enlarged perspective view of one of the message trays which comprises the message organizer of FIG. 1.
Figure 5:
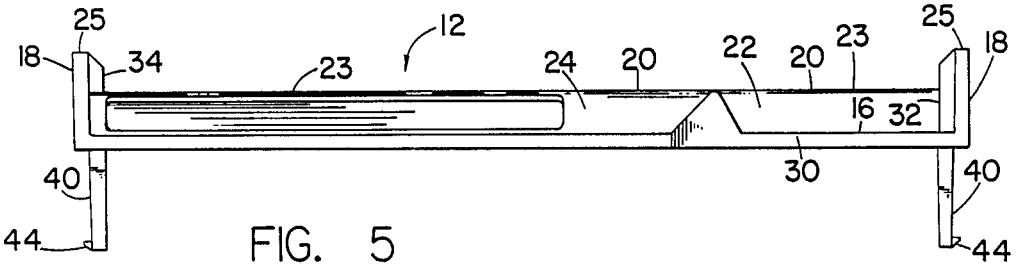
FIG. 5 is an end elevational view of the message tray.
Figure 6:
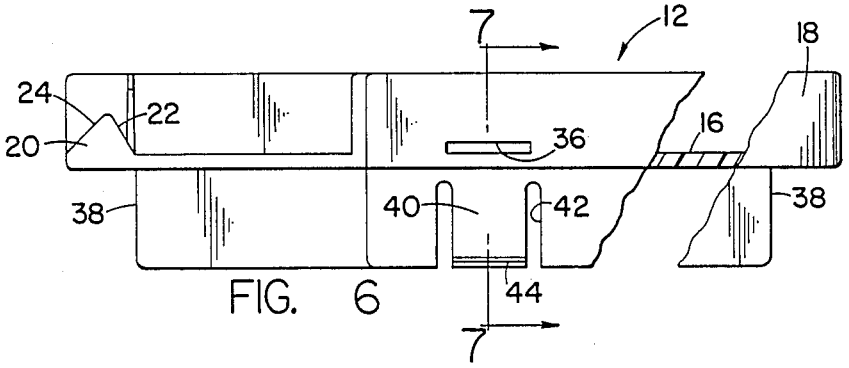
FIG. 6 is a side elevational view of the message tray shown with a portion of one side wall broken away.

The number of message trays assembled to form a message organizer may vary, however, a typical message organizer may comprise from six to twelve trays assembled on a common support base. A typical message tray 12, shown in FIGS. 2–6, preferably comprises a unitary structure molded from durable light weight plastic material of substantially uniform thickness. The illustrated tray 12 and has a horizontally disposed planar bottom wall 16, pair of generally rectangular vertically disposed side walls 18,18, which extend upward from opposite sides of the bottom wall, and a pair of parallel end walls 20,20, which extend upward from the bottom wall 16 in normal relation to the side walls 18,18. Each end wall 20 is partially defined by a upwardly and outwardly inclined inner surface 22 and a upwardly and inwardly inclined outer label surface 24. A shallow elongated recess opens through each outer surface 24 for receiving a suitable label. The upper edges of the end walls 20,20 are disposed a substantial distance below the upper edges of the side walls 18,18, as best shown in FIGS. 4–6.

Figure 3:
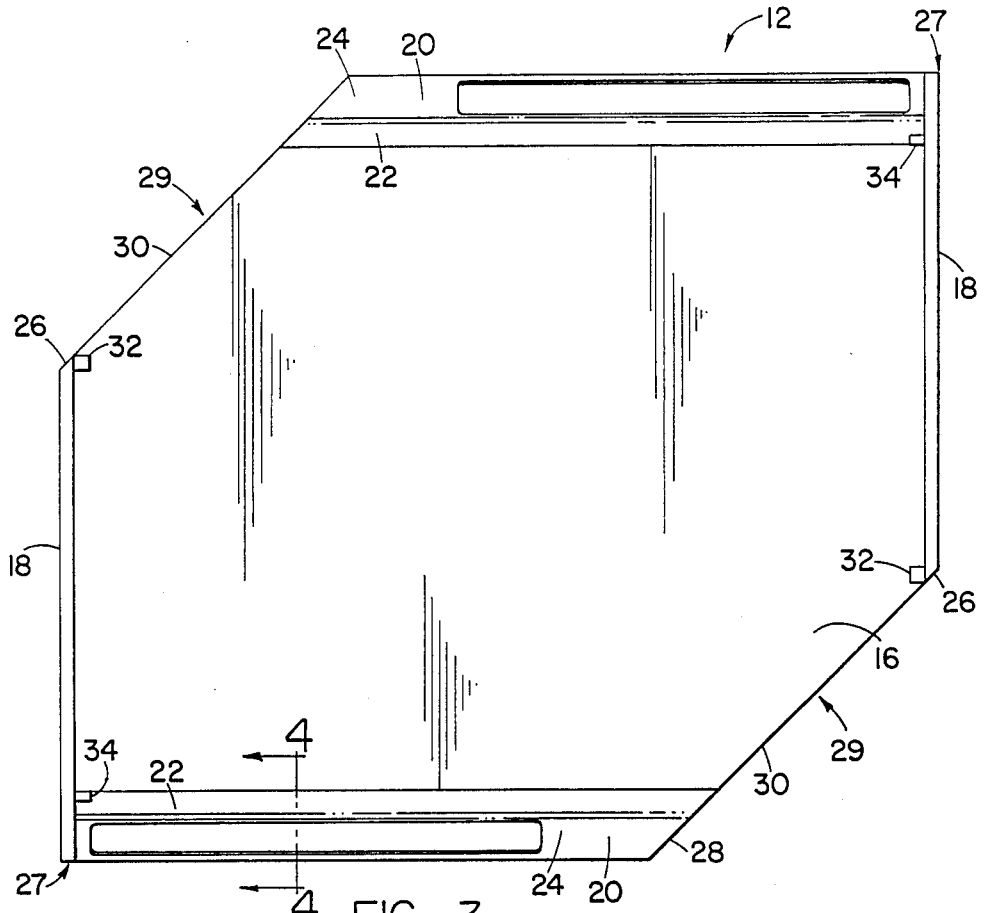
FIG. 3 is a somewhat further enlarged plan view of the message tray shown in FIG. 2.

The message tray of the present invention has at least two diagonally opposed corners and at least one truncated corner. However, the presently preferred message tray 12 has two diagonally opposed corners, indicated generally at 27,27, and two diagonally opposed truncated corners, designated generally by the numerals 29,29 (FIG. 3). Each corner 27 is formed by the intersection of a side wall 18 and an associated end wall 20. Each side wall 18 has a generally vertically extending free edge 26 and each side wall 20 has a generally vertically extending free edge 28. Each truncated corner 29 is defined by one free edge 26, another free edge 28 and an associated bottom wall edge 30 which extends therebetween.

Figure 7:
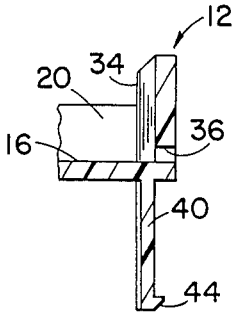
FIG. 7 is a somewhat enlarged fragmentary sectional view taken along the line 7—7 of FIG. 6.

Each side wall 18 has a vertically disposed and inwardly projecting integral rib 32 at its free end 26, and another similarly arranged 34 near its opposite end. A horizontally disposed slot 36 is formed in each side wall 18 generally centrally of the tray 12. Each slot 36 is partially defined by a portion of the inner surface of the bottom wall 16, as best shown in FIGS. 6 and 7.

A pair of support walls 38,38 depend from opposite sides of the bottom wall 16. The outer surface of each support wall 18 and the inner surface of an associated side wall 18, located thereabove, lie within a common vertical plane. A portion of each support wall 38 generally defines a resilient latching tab 40 which is separated from the support wall by a pair of horizontally spaced apart and vertically extending slots 42,42. The latter slots open through the lower end of the support wall as best shown in FIG. 6. Each latching tab 40 has a horizontally disposed and outwardly projecting latch element 44 at its lower end. The latch element 44 is adapted to be received within an associated slot 36 in another tray positioned therebelow, as will be hereinafter further discussed.

Figure 8:
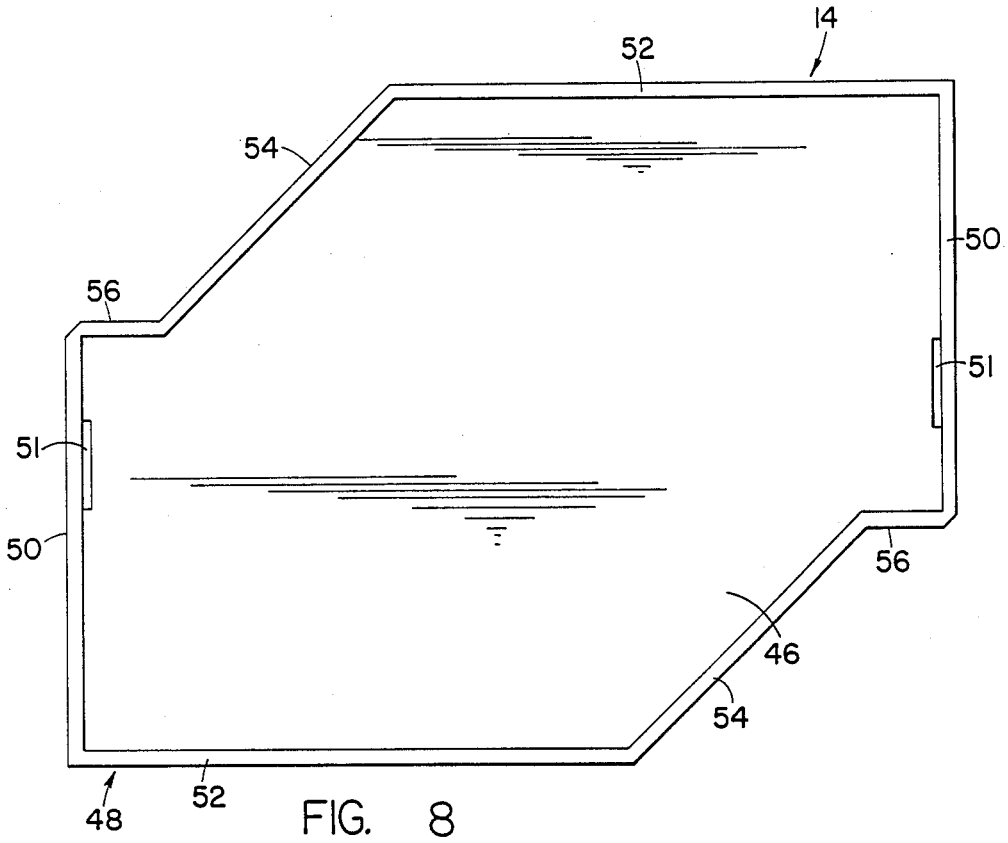
FIG. 8 is a somewhat enlarged plan view of the support base of the message organizer shown in FIG. 1.
Figure 9:
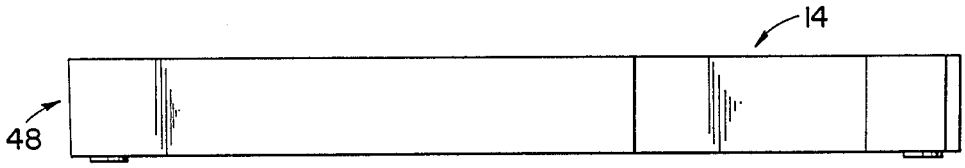
FIG. 9 is an end elevational view of the support base.
Figure 10:
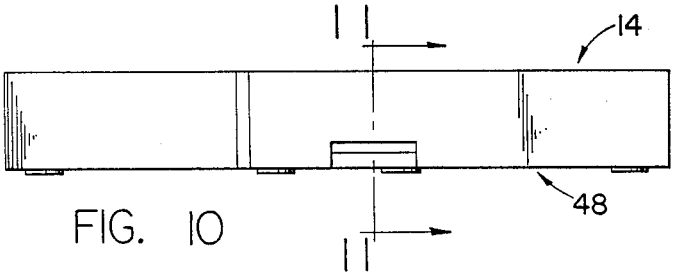
FIG. 10 is a side elevational view of the support base.
Figure 11:
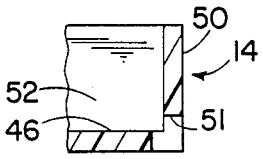
FIG. 11 is a somewhat enlarged fragmentary sectional view taken along the line 11,11 of FIG. 10.

The base 14, best shown in FIGS. 8–11, supports the stack of trays 12,12 and is adapted for snap engagement with the latching tabs 40,40 on the lowermost tray in the stack. It has a bottom wall 46 and a peripheral wall, indicated generally at 48, which extends upward from the bottom wall. The illustrated embodiment, the vertical height of the peripheral wall 48 is substantially equal to the vertical dimension of a tray side wall 18. The peripheral wall 48 is partially defined by a pair of parallel base side wall 50,50 laterally spaced apart a distance substantially equal to the lateral spacing between the inner surfaces of the tray side walls 18,18. Each base side wall 50 has a length substantially equal to the distance between the ribs 32 and 34 on an associated tray side wall and cooperates with the bottom wall to define a horizontally extending slot 51 for receiving an associated latch element 44. The peripheral wall 48 is further defined by a pair of end wall portions 52,52 which are of somewhat shorter length than the tray end walls 24,24. The illustrated embodiment, each end wall portion 52 is joined at one end to an associated base side wall 50 and is joined to the opposite side wall portion by a diagonally extending wall portion 54 and a short end wall portion 56. Thus, the opposite corners of the support base 14 are truncated, substantially as shown in FIG. 8.

In assembling the organizer 10 the support walls 38,38 of one tray are inserted into the upwardly open support base 14 inwardly adjacent the base side wall 50,50. The inner surfaces of the opposing wall portions 50 and 56 are spaced apart a distance substantially equal to the length of the support walls 38,38 and serve to guide the support walls and align the latching elements 44,44 with the slots 51,51 during in assembly. The bottom of the one tray engages the upper edge of the peripheral wall 48 the projecting latching elements 44,44 associated with the tray snap into the slots 51,51 in the support base to connect the one tray to the support base 14. In a like manner another tray is connected to the one tray previously assembled with the support base. The support walls 38,38 are received between and guided by the ribs 32,32 and 34,34 on the one tray during assembly. The ribs 32,32 and 34,34 also cooperate with the support walls 38,38 to maintain the trays in vertical alignment with each other. When the bottom wall 16 of the upper tray being assembled approaches engagement with the upper surfaces of the side walls 18,18 on the tray therebelow the resilient latch members 40,40 snap into engagement with associated slots 36,36 in the tray below, thereby connecting the two trays.

Successive trays are assembled in the aforesaid manner until a stack having a desired number of trays is formed. As previously noted, a message organizer having the proportions of the message organizer 10 shown in the drawings may include as many as twelve trays. However, a stable message organizer having a larger number of trays may be made in accordance with the present invention by increasing the proportions of the base and the bottom walls of the associated trays which comprise the message organizer.

The inclined inner surfaces 22,22 on the end walls of the organizer aid in inserting messages into and removing messages from the organizer. The truncated corners of the message organizer make it easy to see whether there is a message in a particular tray. In addition, the truncated corners of the trays expose the corners of the message forms for easy removal.

The upwardly and inwardly inclined label surfaces on the end walls of the desk top message organizer enable a proper viewing angle by a person seated at the desk or approaching it.

I claim:

1. A message organizer comprising an assembly of message trays, each of said trays having a planar horizontally disposed bottom wall, a pair of generally parallel side walls extending along opposite sides of and projecting upwardly from said bottom wall, and a pair of generally parallel end walls extending along opposite ends of said bottom wall in a direction generally normal to said side walls, the upper edges of said end walls being disposed below the upper edges of said side walls, each of said trays having at least one truncated corner defined by a free end of one of said end walls, a free end of an associated one of said side walls and an associated edge of said planar bottom wall extending between said free end of said one end wall and said free end of said associted side wall, said one end wall having an inwardly facing inner surface extending along the length thereof and inclined upwardly and outwardly inclined from said planar bottom wall to the upper edge of said one end wall, and means for maintaining said trays in vertically stacked relation to each other with the truncated corners of said trays in vertical alignment.

2. A message organizer as set forth in claim 1 wherein each one of said trays has two diagonally opposite truncated corners.

3. A message organizer as set forth in claim 1 wherein said maintaining means comprises means for connecting each of said trays in snap-engagement with another of said trays thereabove.

4. A message organizer as set forth in claim 3 wherein said connecting means comprises resilient latching tabs depending from the bottom wall of each of said trays and slots in the side walls of each of said trays for receiving the latching tabs of another of said trays thereabove.

5. A message organizer as set forth in claim 1 including means for distinguishing between said trays comprising said assembly.

6. A message organizer as set forth in claim 5 where said distinguishing means comprises at least one label surface on each of said trays.

7. A message organizer as set forth in claim 4 wherein said slots are partially defined by said bottom wall.

8. A message organizer as set forth in claim 3 wherein said connecting means maintains each of said trays in assembly with another of said trays thereabove with the upper edges of its side walls in near engagement with the bottom wall of said other tray.

9. A message organizer comprising an assembly of identical message trays, and a base supporting said trays, each of said trays having a bottom wall, a pair of generally parallel side walls extending upwardly from said bottom wall and having slots therein and a pair of generally parallel end walls extending in a direction generally normal to said side walls, the upper edges of said end walls being disposed below the upper edges of said side walls, each of said trays having at least two corners formed by intersections of said side and end walls thereof and at least one truncated corner defined by a free end of one of said end wall, a free end of an associated one of said side walls and an edge of said planar bottom wall, said one end wall having an inner surface extending along the length thereof and inclined upwardly and outwardly from said planar bottom wall to the upper edge of said one end wall, said one end wall having an outwardly facing upwardly and inwardly inclined label surface extending along the length thereof, each of said trays having a pair of laterally spaced apart and vertically disposed support walls depending from said bottom wall, each of said support walls having an outer surface which lies within a common plane with the inner surface of an associated one of said side walls, each of said trays having a pair of resilient latching tabs, each of said latching tabs being partially defined by a portion of an associated one of said support walls, said resilient latching tabs on one of said trays cooperating in snap-engagement with said slots in another of said trays therebelow to retain said one tray and said other tray in assembled relation to each other with the truncated corners of said one tray and said other tray in vertical alignment with each other, said base including opposing walls having slots therein, said resilient latching tabs on the lowermost one of said trays comprising said assembly cooperating in snap-engagement with said slots in said base to retain said lowermost of said trays in assembled relation to said base.

10. A message organizer as set forth in claim 1 wherein said guide maintaining means includes inwardly directed ribs extending vertically along at least two opposing walls of each tray.

11. A message organizer as set forth in claim 10 wherein said maintaining means comprises a pair of laterally spaced apart and vertically disposed support walls depending from said bottom wall and received between said ribs.

12. A message organizer as set forth in claim 11 wherein the outer surface of each support wall and the inner surface of each side wall lie within a common plane.

13. A message organizer as set forth in claim 12 wherein said maintaining means comprises means for connecting each of said trays in snap-engagement with another of said trays thereabove including a pair of resilient latching tabs defined by said support walls.

14. A message organizer as set forth in claim 13 wherein said connecting means further comprises slots in said side walls of each of said trays receiving said latching tabs of another of said trays thereabove.

15. A message organizer as set forth in claim 4 wherein each of said slots is partially defined by said bottom wall.

16. A message organizer as set forth in claim 4 including a support base and means for connecting the lowermost tray in said assembly in snap-engagement with said support base.

17. A message organizer as set forth in claim 16 wherein said support base has a bottom wall and a peripheral wall projecting upwardly from said bottom wall and said means for connecting said lowermost tray comprises slots in said support base for cooperating with said latching tabs on said lowermost tray.

18. A message organizer as set forth in claim 1 wherein said one end wall has an outwardly facing upwardly and inwardly inclined label surface extending along the length thereof.

19. A message organizer as set forth in claim 1 wherein each of said end walls has an outwardly facing upwardly and inwardly inclined label surface extending along the length thereof.

20. A message organizer as set forth in claim 2 wherein each of said end walls has an inwardly facing inner surface extending along the length thereof and inclined upwardly and outwardly from said planar bottom wall to the upper edge of the end wall.

* * * * *